US006098485A

United States Patent [19]

Bruns

[11] Patent Number: 6,098,485

[45] Date of Patent: Aug. 8, 2000

[54] LEAD SCREW ACTUATOR

[75] Inventor: Donald G. Bruns, San Diego, Calif.

[73] Assignee: ThermoTrex Corporation, San Diego, Calif.

[21] Appl. No.: 09/141,773

[22] Filed: Aug. 27, 1998

Related U.S. Application Data

[60] Provisional application No. 60/056,846, Aug. 27, 1997.

[51] Int. Cl.[7] ..... G05G 11/00

[52] U.S. Cl. ..... 74/490.07; 74/490.14; 74/825; 192/79

[58] Field of Search ..... 74/490.07, 490.14, 74/825; 192/79

[56] References Cited

U.S. PATENT DOCUMENTS

| | | | |
|---|---|---|---|
| 1,498,979 | 6/1924 | Renison | 192/79 |
| 2,190,447 | 2/1940 | Frazier | 477/12 |
| 4,006,645 | 2/1977 | Newell | 74/490.08 |
| 4,456,937 | 6/1984 | Iftikar et al. . | |
| 4,525,852 | 7/1985 | Rosenberg . | |
| 4,664,487 | 5/1987 | Tam . | |
| 4,798,989 | 1/1989 | Miyazaki et al. . | |
| 5,332,942 | 7/1994 | Rennex . | |

*Primary Examiner*—Allan D. Herrmann
*Attorney, Agent, or Firm*—Fish & Richardson P.C.

[57] ABSTRACT

A high resolution actuator is provided which can be used in extreme environments, e.g., at extremely low temperatures. The actuator uses electromagnetic forces to actuate levers which then cause rotation of a lead screw. The actuator uses very small gaps in the magnetic circuit to achieve a high force with a small input power.

3 Claims, 7 Drawing Sheets

LEAD SCREW ACTUATOR

CROSS REFERENCE TO RELATED APPLICATIONS

This application is a conversion of U.S. Provisional application Ser. No. 60/056,846, filed Aug. 27, 1997.

FIELD OF THE INVENTION

The present invention relates to actuators, and more particularly to a high resolution actuator which may be used at cryogenic temperatures.

BACKGROUND OF THE INVENTION

Actuators are known. However, some actuators must operate in extreme environments. For example, there is a need for an actuator which can operate at high resolution in cryogenic temperatures, such as below 77K. Such actuators would be especially useful in space applications.

SUMMARY OF THE INVENTION

The present invention provides a high resolution actuator which can be used in extreme environments, e.g., at extremely low temperatures. The invention uses electromagnetic forces to actuate levers which then cause rotation of a lead screw. The invention uses very small gaps in the magnetic circuit to achieve a high force with a small input power.

Advantages of the invention include one or more of the following. The actuator can operate at very low temperatures, such as cryogenic temperatures. The actuator has high resolution. The actuator requires low power and has low mass. The actuator is highly versatile, and can operate at high temperatures, replacing piezoelectric actuators. For use in spacecraft, launch stress calculations have been performed and show that the flexures and other components of the actuators are adequate at more than 100 g's.

DETAILED DESCRIPTION

Figure 1:
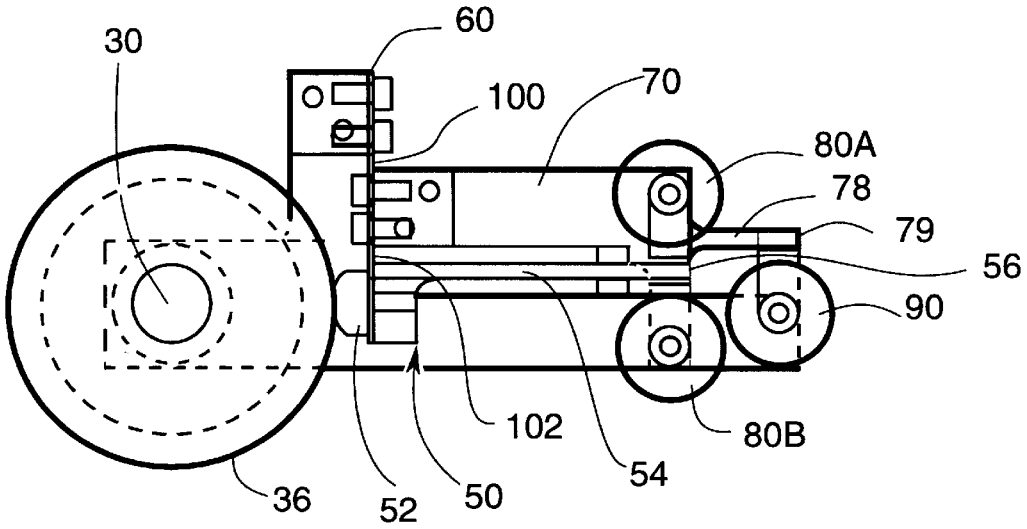
FIG. 1 is a top view of an actuator according to an embodiment of the present invention.
Figure 2:
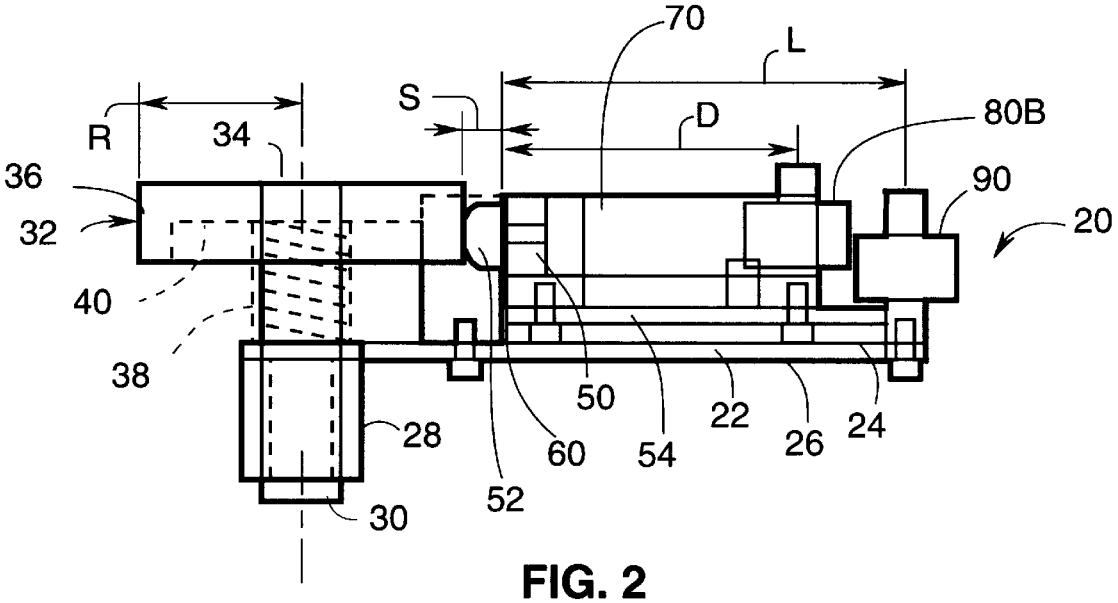
FIG. 2 is a side view of an actuator according to an embodiment of the present invention.
Figure 3A:
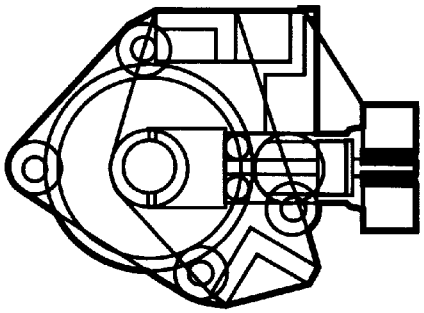
FIGS. 3(*a*)–(*d*) are four sketches of the actuator according to an embodiment of the present invention.
Figure 3B:
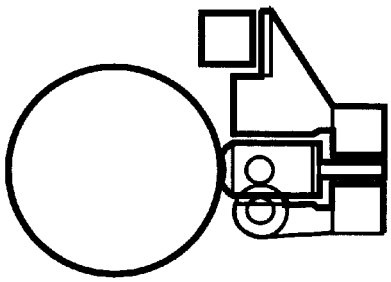
Figure 3C:
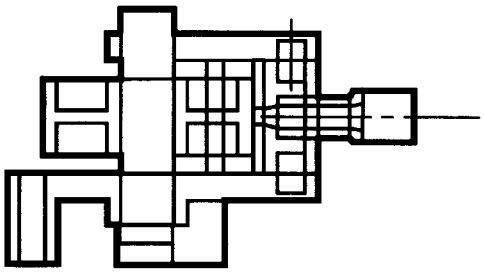
Figure 3D:
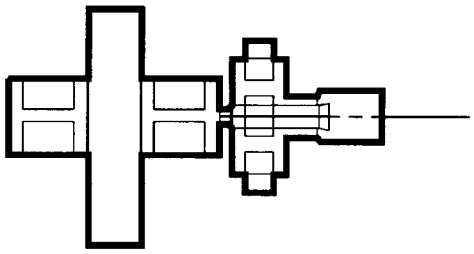

FIGS. 1 and 2 are top and side views of an actuator 20. The actuator 20 includes a frame or support member 22 which may be fixed relative to the environment in which the actuator operates. The frame 22 has upper and lower surfaces 24 and 26, respectively. An internally threaded collar 28 depends from the lower surface 26 and is rigidly connected to the support frame. An externally threaded lead screw 30 is carried by the threaded collar 28 and projects upwardly through a hole in the frame 22. A hardened steel drive wheel 32 is rigidly connected to the lead screw 30 adjacent the upper end 34 of the screw. The wheel 32 has a cylindrical outer perimeter surface 36. A spring 38 is compressed between the upper surface 24 of the frame 22 and the underside 40 of the wheel 32. The spring maintains a firm longitudinal engagement between the screw 30 and frame 22 so as to prevent lash in the movement of the screw 30.

If the screw 30 is of conventional right-handed threading, then clockwise rotation of the head 36 and screw 30 (as viewed in the top view of FIG. 1) will cause the head and screw to lower or descend relative to the frame 22. A counterclockwise rotation will cause the head and screw to raise or ascend. These would be reversed if the screw were left-hand threaded.

As is described in further detail below, a friction pawl 50 having a hardened steel head 52 is used to rotate the wheel 32 clockwise or counterclockwise in discrete increments via a friction contact between the head 52 and wheel perimeter 36.

A 0.01 inch thick steel flexure 60 is rigidly coupled to the support frame 22 at one end. At the other end, the flexure 60 is rigidly coupled to the pawl 50. Mediately, the flexure 60 is rigidly coupled to a carriage member 70. The flexure 60 thus defines a carriage pivot location 100 about which the carriage may rotate in a horizontal plane relative to the frame 22. The flexure 60 also defines an effective pawl pivot location 102 about which the pawl 50 may rotate in a horizontal plane relative to the carriage 70. The pawl 50 has a pawl lever 54 with a distal end 56. The distal end 56 is located between a pair of cocking/actuating coils 80A, 80B rigidly affixed to the carriage 70. Coil 80A may be energized to attract the pawl lever 54, and thereby rotate the pawl 50 counterclockwise about the pivot location 102 (as viewed from the top). Similarly, coil 80B may be energized to rotate the pawl 50 clockwise. The carriage includes a carriage lever 78 with a distal end 79. A clutch coil 90 is rigidly carried by the frame 22 adjacent the distal end 79 of carriage lever 78. The clutch coil may be energized to attract the carriage lever 78, and thereby rotate the carriage 70 (including the pawl) clockwise about the pivot location 100.

With the flexure 60 in a relaxed state and the coils unpowered, the pawl head 52 is not engaged to the wheel perimeter 36. The pawl 50 is in a neutral position with its lever 54 approximately intermediate the coils 80A and 80B.

If it is desired to raise the lead screw 30, the wheel 32 must be rotated counterclockwise. To do this, the coil 80A is energized to rotate the pawl counterclockwise about the pawl pivot location 102 to reach a counterclockwise-most position. The clutch coil 90 is then energized to rotate the carriage 70 clockwise about the carriage pivot location 100 bringing the pawl head 52 into engagement with the drive wheel perimeter 36. The coil 80A may then be turned off and the coil 80B energized to rotate the pawl 50 clockwise from its counterclockwise-most position; back through the neutral position, to its clockwise-most position. During this rotation, friction between the pawl head 52 and the drive wheel 36 produces a counterclockwise rotation of the wheel 32 by a fixed rotational increment. The result is that the lead screw is raised by a fixed linear increment. The particular rotational increment is determined by the amount of rotation of the pawl 50 between its counterclockwise-most and clockwise-most positions and the various dimensions and geometries of the actuator and its components. The clutch coil 90 may then be turned off to allow the carriage to return to its neutral position, disengaging the pawl head 52 from the wheel head 36. The coil 80B may then be turned off to allow the pawl 50 to return to its neutral position. If it is desired to raise the lead screw by a further increment, the process may be repeated. If it is desired to lower the lead screw, the process may be repeated, energizing coil 80A in place of 80B and vice versa.

An array of such actuators may be used to configure a deformable mirror. An exemplary use is in a space-based telescope.

Figure 11:
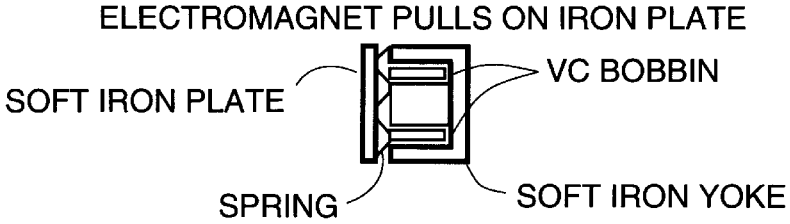
Figure 12:
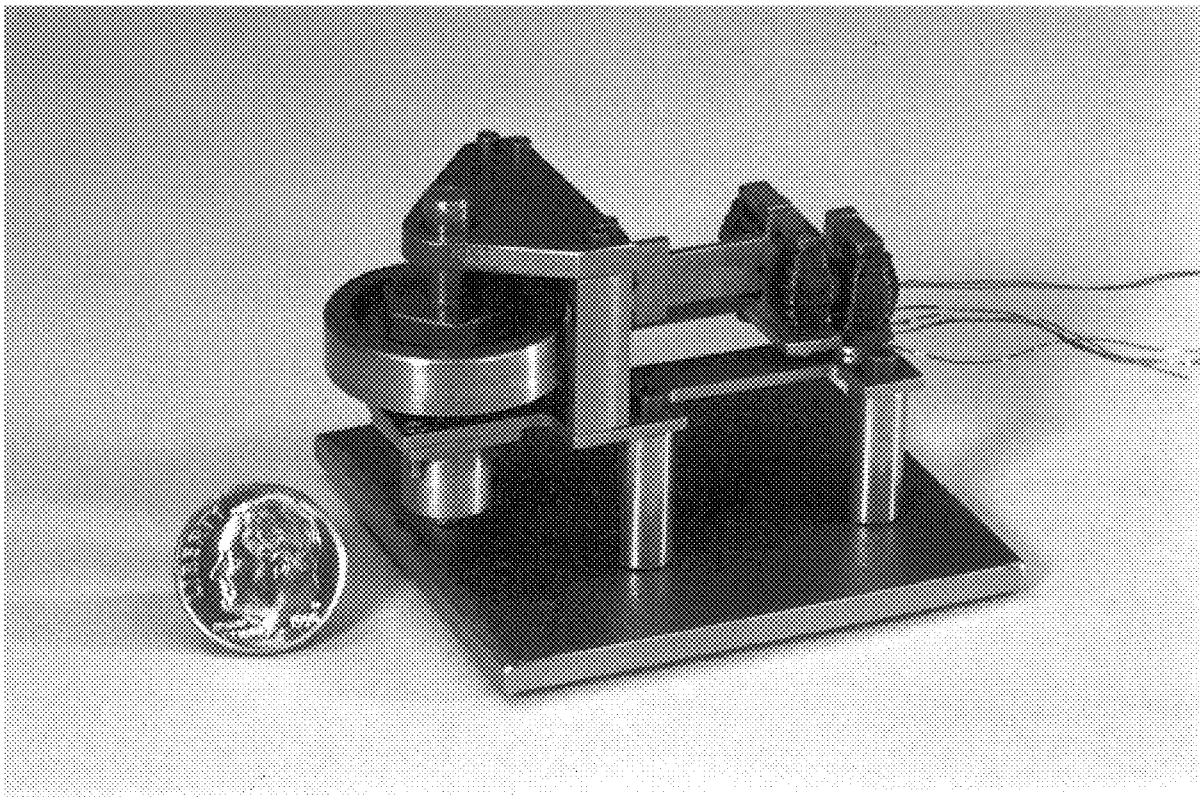
FIG. 12 is a photograph of an actuator according to an embodiment of the present invention.
Figure 13:
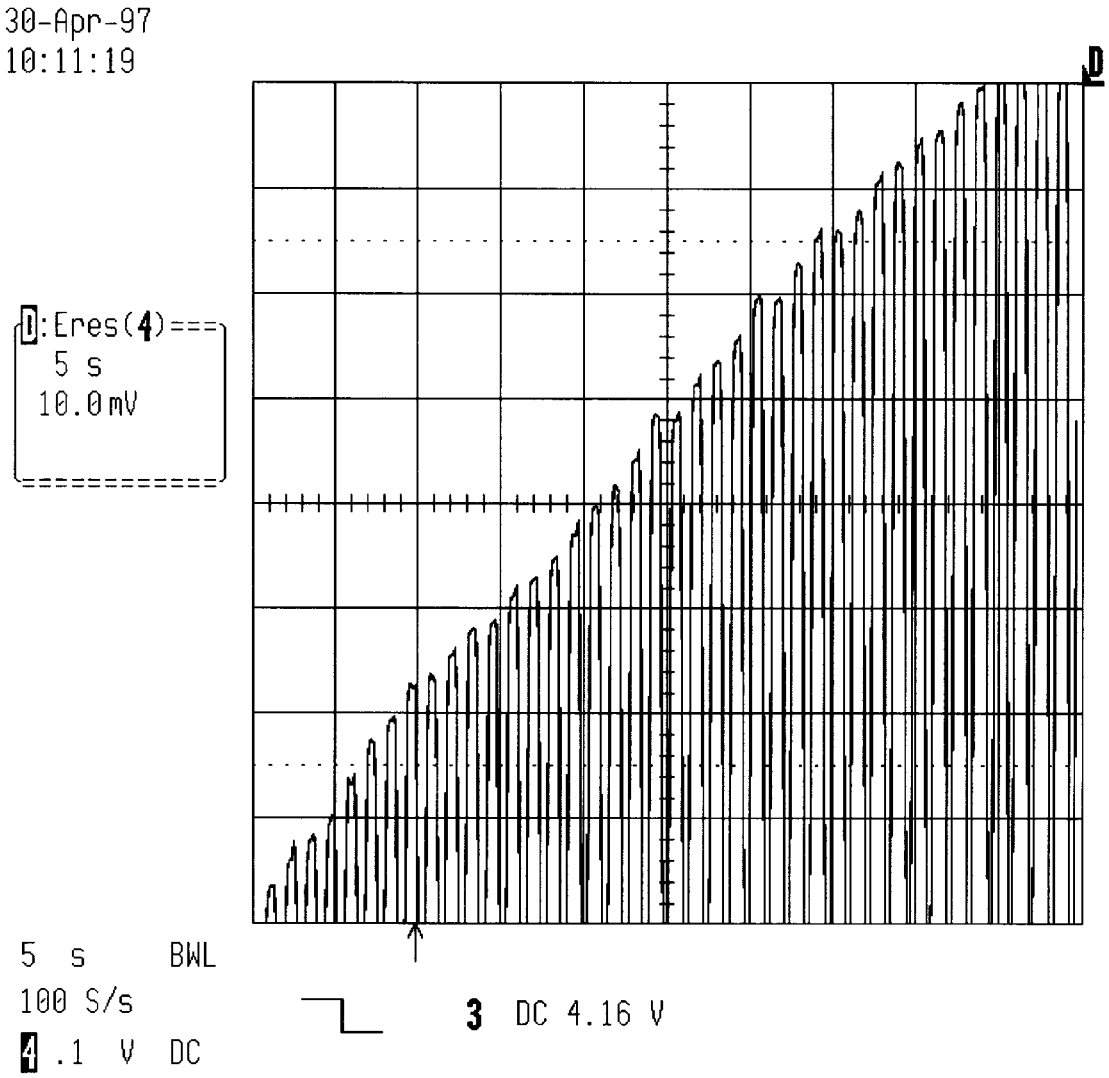
FIG. 13 is a graph showing a number of steps of an actuator, graphed as distance versus time.

FIGS. 3(*a*)–(*d*) through FIG. 11 illustrate and describe various actuators. These figures are described in more detail below. In certain embodiments, rotary flexures may be used to provide axes of rotation for the carriage and pawl members. In certain embodiments, a spring-loaded split nut may be used as a supplement or in place of the collar 28 and spring 38 to provide the necessary anti-lash properties. In some embodiments, the screw 50 and drive wheel 32 may be other than fixedly attached. For example, the drive wheel 32 may be splined to the screw 30 so that the drive wheel 32 only rotates while the screw 30 also translates. In some embodiments, the force by which the pawl 50 moves the wheel 32 or by which the carriage 70 is held so that the pawl 50 engages the wheel may be stored in spring members, the original energy being supplied by coils or other force sources. FIGS. 12 and 13 disclose and describe the properties and operation of one prototype embodiment of an actuator.

Figure 4:
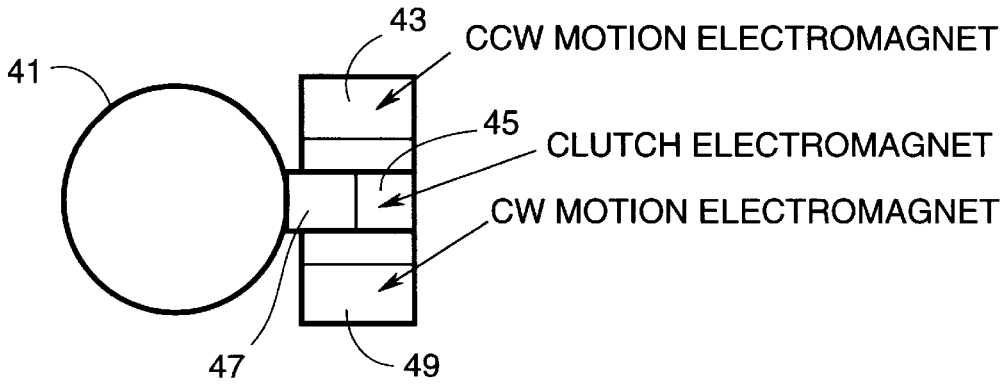
FIGS. 4–6 are figures illustrating a flexure support for the rotating element.
Figure 5:
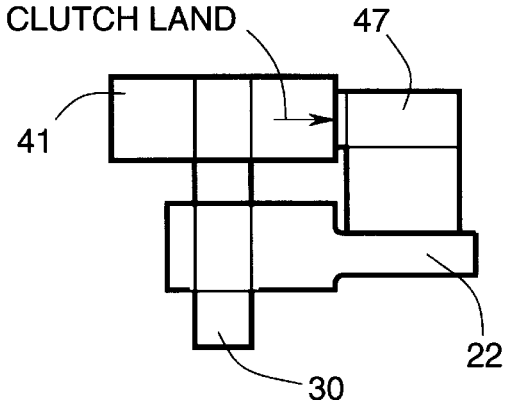
Figure 6:
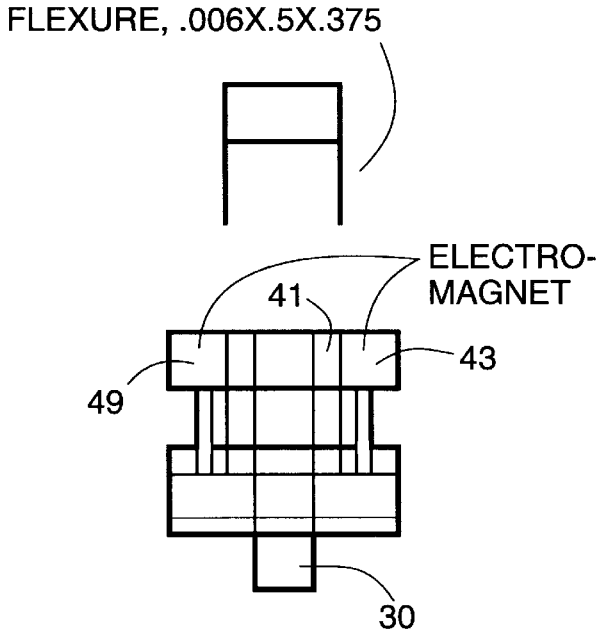

Referring to FIG. 4, another embodiment of the cryogenic actuator is shown. A wheel 41 is shown which may frictionally engage with a pawl 47. Movement of the pawl 47 towards or away from wheel 41 is controlled by a clutch electromagnet 45 in a similar manner as that described above. Movement of pawl 47 to effect rotational movement of wheel 41 is controlled by either of two motion electromagnets 43 and 49. Electromagnet 43 provides a counterclockwise motion to wheel 41. Electromagnet 49 provides a clockwise motion to wheel 41. FIGS. 5 and 6 show side and longitudinal views of this embodiment, respectively.

This type of support hag several advantages. Little or no play is allowed in the construction. The actuator is self-centering. The number of wearing surfaces is minimized. For example, the materials described herein are not critical. For example, PZTs could be used in place of magnetic coils.

Figure 7:
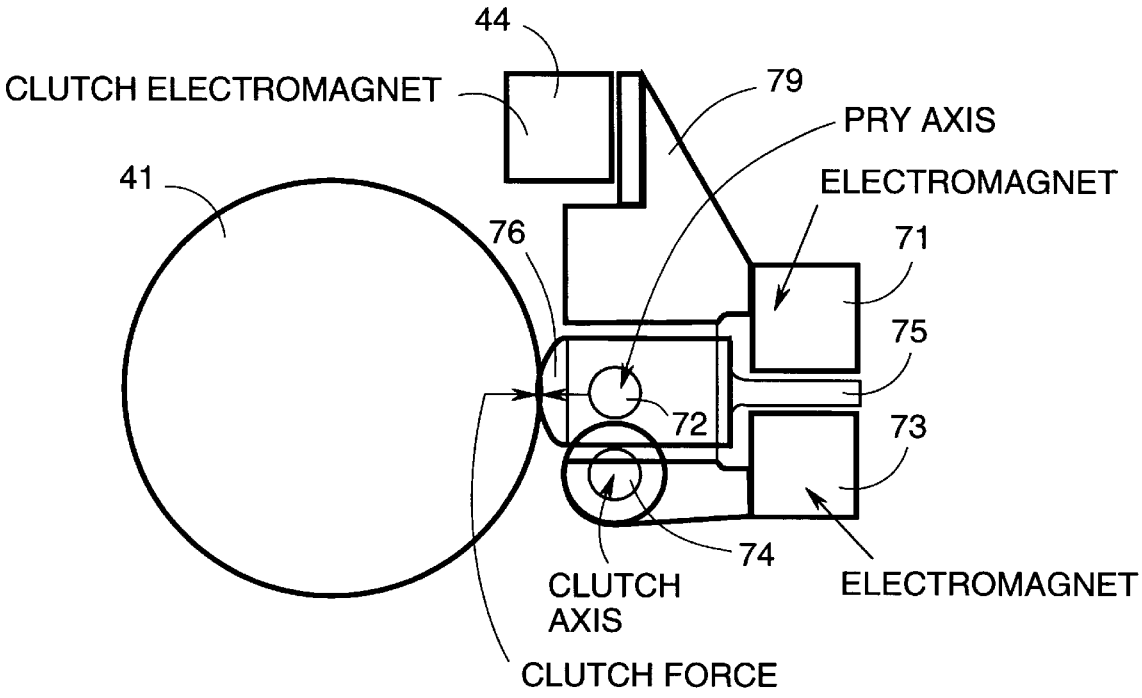
FIGS. 7–8 are figures showing an embodiment of the present invention in which the actuator employs so-called "Bendix" flexures.

FIG. 7 shows an alternate embodiment of the present invention employing so-called Bendix flexures. Again, wheel 41 is shown engaging the actuator. In this case, a Bendix rotational flexure 79 is shown which is driven by a clutch electromagnet 77. The clutch axis 74 is also shown. Electromagnetic actuation of electromagnet 77 causes pawl 76 to engage or disengage wheel 41. Engagement or disengagement of pawl 76 to wheel 41 occurs about axis 74.

Once pawl 76 frictionally engages wheel 41, electromagnets 71 and 73 may be employed, acting on extension 75, to rotate pawl 76 about axis 72. The action of electromagnets 71 or 73 in rotating pawl 76 about axis 72 results in a corresponding movement of wheel 41, as the same is frictionally engaged to pawl 76.

In this embodiment, as in others, a split nut clamp may be used to bias wheel 41 upward. If a split nut clamp is used, the split nut clamp force may be held low enough to allow a comfortable margin on the drive torque. In some cases, the clutch force may lever the nut halves apart. Such problems may be solved by employing upper bearings.

It is also noted that the clutch pivot must be able to withstand the environmental conditions to which it is exposed. For example, for a space-borne application, the clutch pivot must be able to withstand the launch acceleration. Furthermore, the clutch pivot should have a low torsional stiffness.

Figure 8:
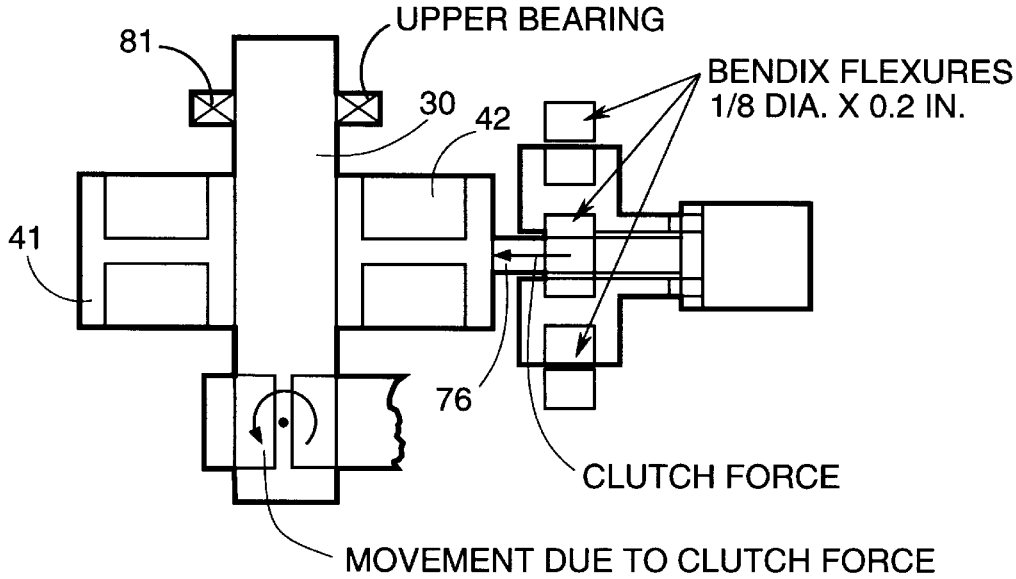

In this case, a separated bearing may be employed, exemplified in FIG. 8. In FIG. 8, an upper bearing 81 is shown attached to lead screw 30. Wheel 41 is also shown, and may optionally employ voids 42 to lower the same's overall mass. Pawl 76 is shown as well. In this case, a pair of Bendix flexures may be employed which results in a lower torsional stiffness.

The rotary flexures simplify lever design. Such levers may be designed to increase the travel required at the magnets and increase the net force generated by each magnet. This makes control easier and allows a reduction in the size of the electromagnets. For example, in the embodiment shown, an approximately 3:1 advantage for the clutch magnet is shown. This may be increased, e.g., to 6:1, by moving the clutch pivot bearing closer to the pry axis bearing. In many cases, however, construction is more difficult when the two axes are moved closer together.

Figure 9:
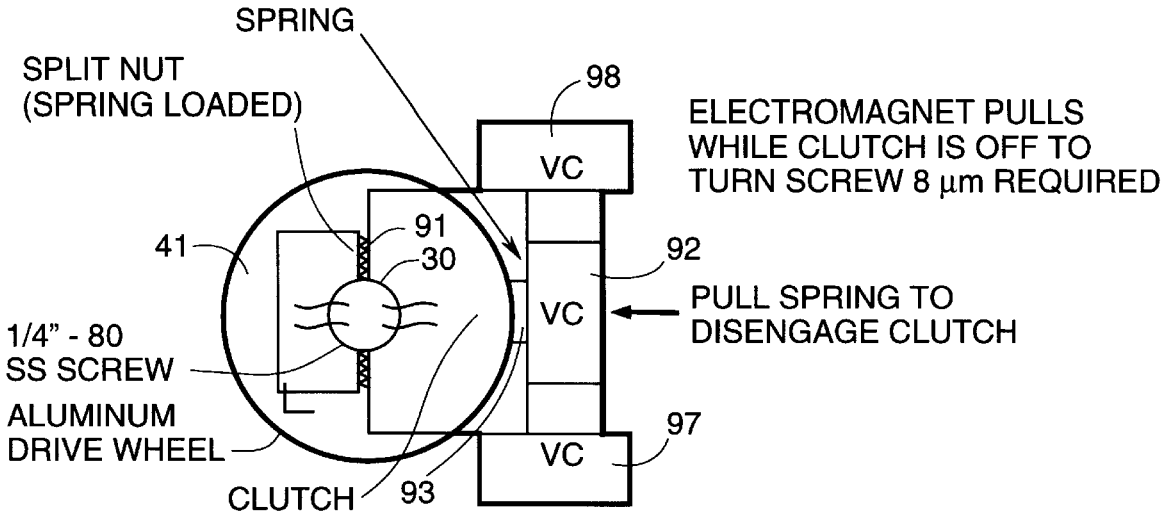
FIGS. 9–11 are top views of the actuator according to an embodiment of the present invention illustrating the pull of the electromagnet while the clutch is off, this action rotating the lead screw.
Figure 10:
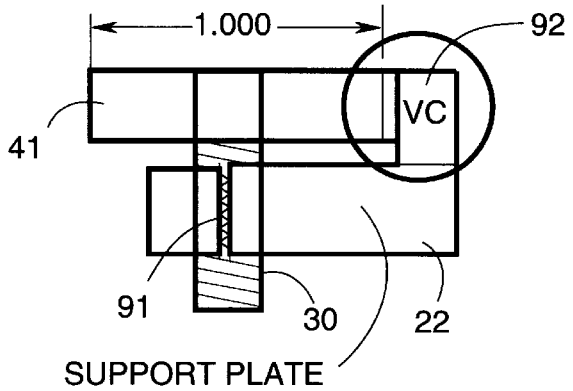

FIG. 9 shows yet another embodiment to the present invention, in which wheel 41 is shown concentric with lead screw 30. A spring loaded split nut 91 is shown which may, e.g., be structured and arranged to allow rotation of wheel 41, and subsequent translation of the wheel out of the plane of the page, while the clutch is engaged. In FIG. 9, spring 92 is shown pushing pawl 93 into engagement with wheel 41. By pulling spring 92, the clutch may be disengaged. The electromagnets 98 and 97 may be used to translate pawl 93 in such a way as to rotate wheel 41 in a clockwise or counterclockwise manner as desired.

FIG. 12 shows a prototype actuator which may be used to drive a thin mirror, such as a space-borne telescope. The prototype actuator shown operates as described above and employs a clutch combined with a lever to apply torque to a lead screw drive wheel. Both clutch and lever are actuated by electromagnets. The actuator is designed to operate in discrete steps, each step translating into a displacement of approximately 20 nanometers. The lead screw can be driven in either direction. No power is required to keep the actuator stationary. The operating stroke is determined by the lead screw length, so, e.g., 5 millimeters may be easily achieved.

FIG. 13 shows an operation of the actuator. A sequence of 40 steps over a 50-second period is plotted on a vertical scale of 100 nanometers/division. As may be seen, high resolution and stability are achieved.

Operation of the actuator at cryogenic temperatures is similar to that at room temperature. The power dissipation at low temperatures may even be less than at higher temperatures due to the drop in ohmic resistance of the coils. The relevant mechanical forces are similar at both low temperatures and at room temperature. At liquid nitrogen temperatures, some actuators according to embodiments of the present invention may require about 100 mJ per 20 nanometer step. The energy is dissipated in the magnet coils, raising the temperature of the assembly only a very small fraction of a Kelvin.

The actuator may be driven with a single, multiplexed pulsed-current driver. Such a driver may be located in the electronics assembly, which is generally at a higher temperature, and may receive position commands from the controller. Cryogenic FET switching transistors located at each actuator may be used to de-multiplex the signals. Such a design may be advantageous because it requires only a single electronics bus to connect all of the actuators.

To test the actuator at room temperature, micrometer replacement actuators may be used as are available from Picomotors from New Focus, Inc. Such actuators have the appropriate resolution, stroke, mass, and power requirements similar to the present invention, but do not operate at cryogenic temperatures.

Design considerations for other varying designs according to the invention may include having ample design margins. For example, the drive torque may be designed to be several times the friction force. For space-borne applications, such actuators generally require low weight and the ability to survive the launch. Construction of the actuator may be conveniently performed by fabricating the structural parts out of aluminum, resulting in a lighter overall design.

The invention has been described with respect to a number of embodiments. Of course, the invention is not limited by the embodiments shown and described, but only by the claims appended hereto.

What is claimed is:

1. An actuator comprising:

a frame;

a drive wheel rotatable about a wheel axis and having a generally annular perimeter;

a driven member linearly driven substantially parallel to the wheel axis by rotation of the drive wheel about the wheel axis;

a pawl, having a head for engaging the wheel perimeter and a lever;

a carriage carrying the pawl, the pawl rotatable relative to the carriage about a pawl pivot location, the carriage carried by the frame and rotatable relative to the frame about a carriage pivot location;

first and second force generators for respectively applying force to the pawl lever in first and second directions about the pawl pivot location; and a third force generator for applying force to a carriage lever in at least one direction about the carriage pivot location.

2. The actuator of claim 1, wherein the third force generator selectively applies a force to rotate the carriage about the carriage pivot so as to bring the pawl head into sufficiently firm engagement with the wheel perimeter so as to enable rotation of the pawl about the pawl pivot location to rotate the wheel about the wheel axis.

3. An actuator comprising:

a frame;

a drive wheel rotatable about a wheel axis and having a generally annular perimeter;

a driven member linearly driven parallel to the wheel axis by rotation of the drive wheel about the wheel axis;

a pawl, having a head for engaging the wheel perimeter;

engagement means for bringing the pawl head into and out of engagement with the wheel perimeter; and actuating means for selectively moving the pawl head when the pawl head is engaged to the wheel perimeter so that friction contact movement between the pawl head and the wheel perimeter causes a responsive rotation of the drive wheel about the wheel axis.

* * * * *